US007431658B2

(12) United States Patent
Priegel

(10) Patent No.: US 7,431,658 B2
(45) Date of Patent: Oct. 7, 2008

(54) GOLF CUP

(75) Inventor: Jack C. Priegel, El Paso, TX (US)

(73) Assignee: Wind Gear Direct, LLC, El Paso, TX (US)

( * ) Notice: Subject to any disclaimer, the term of this patent is extended or adjusted under 35 U.S.C. 154(b) by 0 days.

(21) Appl. No.: 11/668,949

(22) Filed: Jan. 30, 2007

(65) Prior Publication Data

US 2008/0182677 A1 Jul. 31, 2008

(51) Int. Cl.
*A63B 57/00* (2006.01)

(52) U.S. Cl. ..... 473/175

(58) Field of Classification Search ..... 473/173–180
See application file for complete search history.

(56) References Cited

U.S. PATENT DOCUMENTS

| | | | |
|---|---|---|---|
| 979,313 | A | 12/1910 | King et al. |
| 1,291,067 | A | 1/1919 | Michael |
| 1,548,289 | A | 8/1925 | Sparks |
| 1,568,320 | A | 1/1926 | Coldwell |
| 1,599,734 | A | 9/1926 | Wilson |
| 1,676,954 | A | 7/1928 | Kannemann |
| 1,829,283 | A | 10/1931 | Kip |
| 3,310,026 | A | 3/1967 | Baird, Jr. |
| 3,348,797 | A | 10/1967 | Turbyfill |
| 3,732,845 | A | 5/1973 | Istre |
| 4,114,879 | A | 9/1978 | Oiler |
| 4,120,496 | A | 10/1978 | Niina |
| 4,360,200 | A | 11/1982 | English |
| 4,928,417 | A | 5/1990 | Boudreau |
| 5,249,384 | A | 10/1993 | Dark, Jr. |
| 5,351,950 | A | 10/1994 | Frankum |
| 5,382,018 | A | 1/1995 | Browne |
| 5,393,053 | A | 2/1995 | Wiese et al. |
| 5,451,045 | A | 9/1995 | Garske |
| 6,113,503 | A | 9/2000 | Brookman |
| 6,409,608 | B1 | 6/2002 | Garske |
| 6,478,687 | B1 | 11/2002 | Colonello |
| 6,712,714 | B2 | 3/2004 | Joswick |
| 6,722,997 | B2 | 4/2004 | Gilmour |
| 6,726,170 | B2 | 4/2004 | Luo |
| 6,726,575 | B1 | 4/2004 | Thorp et al. |
| 6,767,289 | B2 | 7/2004 | Porter |
| 6,902,491 | B2 | 6/2005 | Barlow et al. |
| 6,939,239 | B1 | 9/2005 | Ash |
| 7,033,279 | B2 | 4/2006 | Garske |
| 7,033,280 | B2 | 4/2006 | Hottle et al. |
| 2002/0094878 | A1 | 7/2002 | Porter |
| 2006/0189401 | A1 | 8/2006 | Garske |

OTHER PUBLICATIONS

Reliable Golf Course Supplies, 2006 Golf Course Supply Catalog, p. 23.

*Primary Examiner*—Mark S Graham
(74) *Attorney, Agent, or Firm*—Fitch, Even, Tabin & Flannery

(57) ABSTRACT

A golf cup is provided that has a cylindrical wall defining an interior. The golf cup includes an insert formed from a non-metallic material positioned in the interior to form two chambers. The insert and chambers are arranged and configured to effect an audible indication upon an object, such as a golf ball, being dropped into the interior of the golf cup through the receiving opening. In one form, the audible indication is similar to that obtained from a golf ball being dropped into a metallic golf cup that is buried in the ground.

19 Claims, 7 Drawing Sheets

FIG. 3
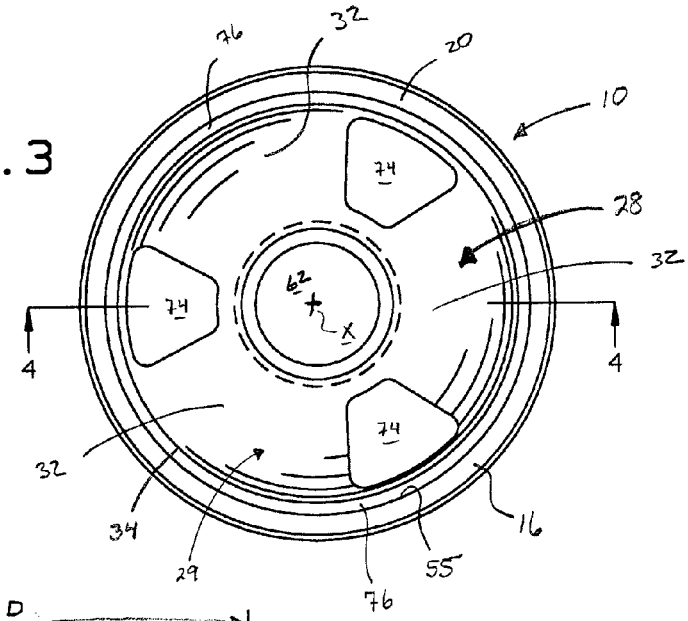
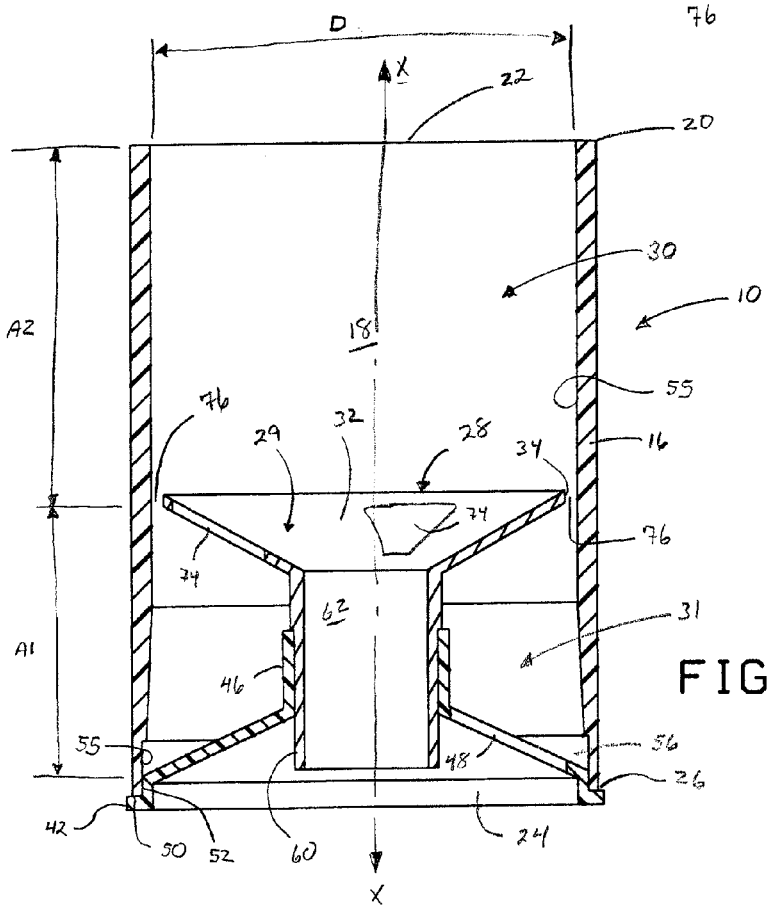
FIG. 4

FIG. 9
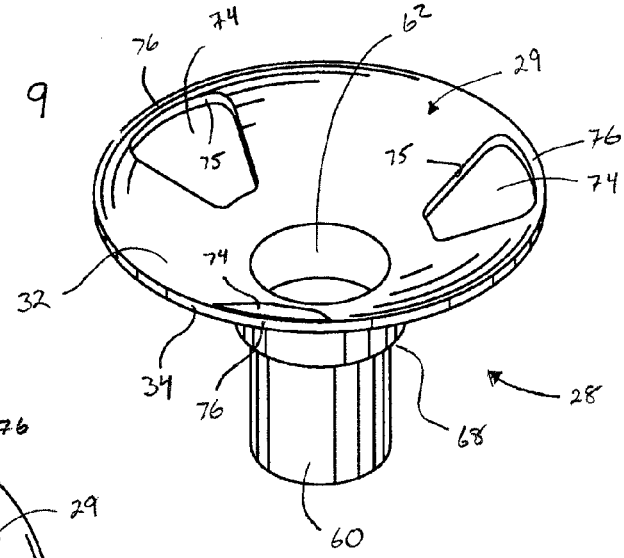
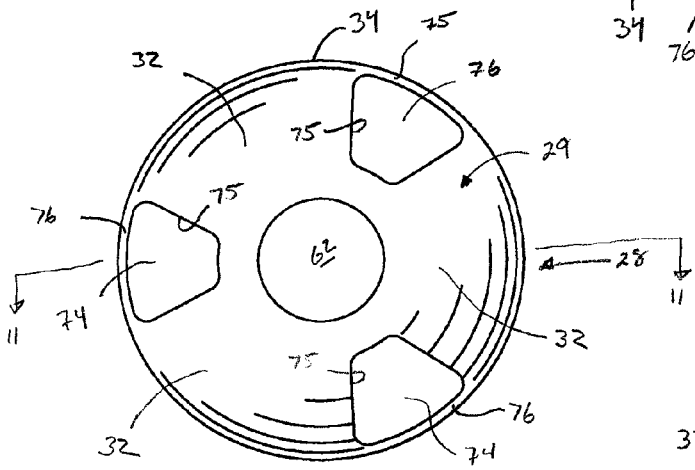
FIG. 10
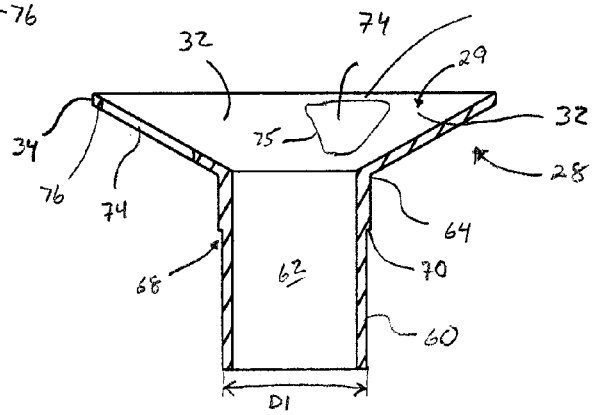
FIG. 11

GOLF CUP

FIELD

The invention generally relates to golf cups, and in particular, to golf cups providing an audible indication of a golf ball received in the cup.

BACKGROUND

Traditionally, golf cups are formed from metal. The metallic cups produced a characteristic audible sound when a golfer putted the ball into the cup. For many golfers, this characteristic, metallic sound is associated with the sinking of a putt and, therefore, provides added pleasure and enjoyment to the game of golf. As a result, the sound that a golf ball makes when dropped into the metallic cup is often considered part of a game of golf.

Metal golf cups, however, are expensive and may corrode due to exposure to the environment. As a result, they are often replaced by plastic cups to better withstand exposure to weather, soil, and the environment. While plastic cups are more economical and durable, they have the shortcoming that they do not provide the characteristic metallic sounds when a golf ball is dropped into the cup. As a result, many golfers find plastic cups unsatisfactory because they are not rewarded with the traditional metallic-cup sound when they sink their putt.

In order to replicate this characteristic sound in non-metallic cups, some golf cups employ electronic speakers, metallic bells, or other metallic sounding plates. For example, some cups use springs or biased assemblies to strike a metallic plate or bell, and other cups use electronic circuit boards and contacts to generate sounds. These cups are generally undesired because they require costly and complex assemblies to produce the audible sounds or still incorporate metallic components that can eventually corrode when exposed to the environment.

Accordingly, it is desired to form a simple golf cup of non-metallic materials that is capable of producing the characteristic sound of a metallic cup when a golf ball is dropped into the cup.

BRIEF DESCRIPTION OF THE DRAWINGS

FIG. 3 is a top plan view of the golf cup of FIG. 2;

FIG. 4 is a cross-sectional view of the golf cup of FIG. 3 generally taken along lines 4-4;

FIG. 9 is a perspective view of one exemplary embodiment of an insert portion of the golf cup of FIG. 2;

FIG. 10 is a top plan view of the insert portion of FIG. 9;

FIG. 11 is a cross-sectional view of the insert portion of FIG. 10 generally taken along lines 11-11 in FIG. 10;

DETAILED DESCRIPTION

Figure 1:
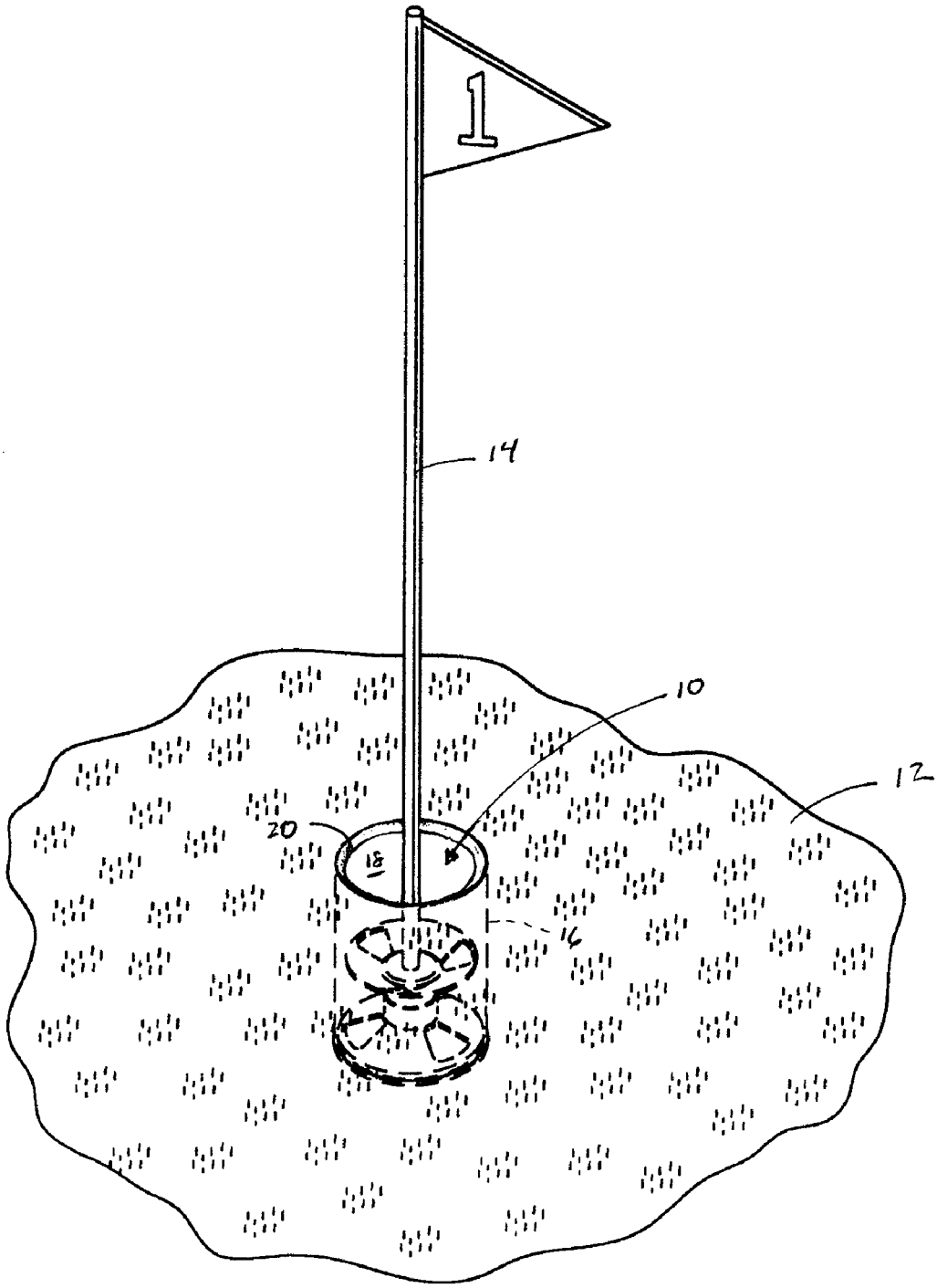
FIG. 1 is a perspective view of one embodiment of a golf cup shown in an exemplary environment.

Turning to the figures, a golf cup 10 is illustrated that includes non-metallic components configured to produce a distinctive audible indication when an object, such as a golf ball 11, is dropped into the cup 10. Preferably, this audible indication is similar to that obtained from a golf ball dropped into a traditional metallic cup buried in the ground, such as a golf course green. As shown in FIG. 1, the golf cup 10 is suitable for use on a common golf course green 12 and is configured to support a typical golf flag pole 14. Other uses of the cup 10 are also possible, such as on putting greens, mini-golf courses, and other applications where it is desired for an audible indication of an object dropped or inserted into a recess.

Figure 2:
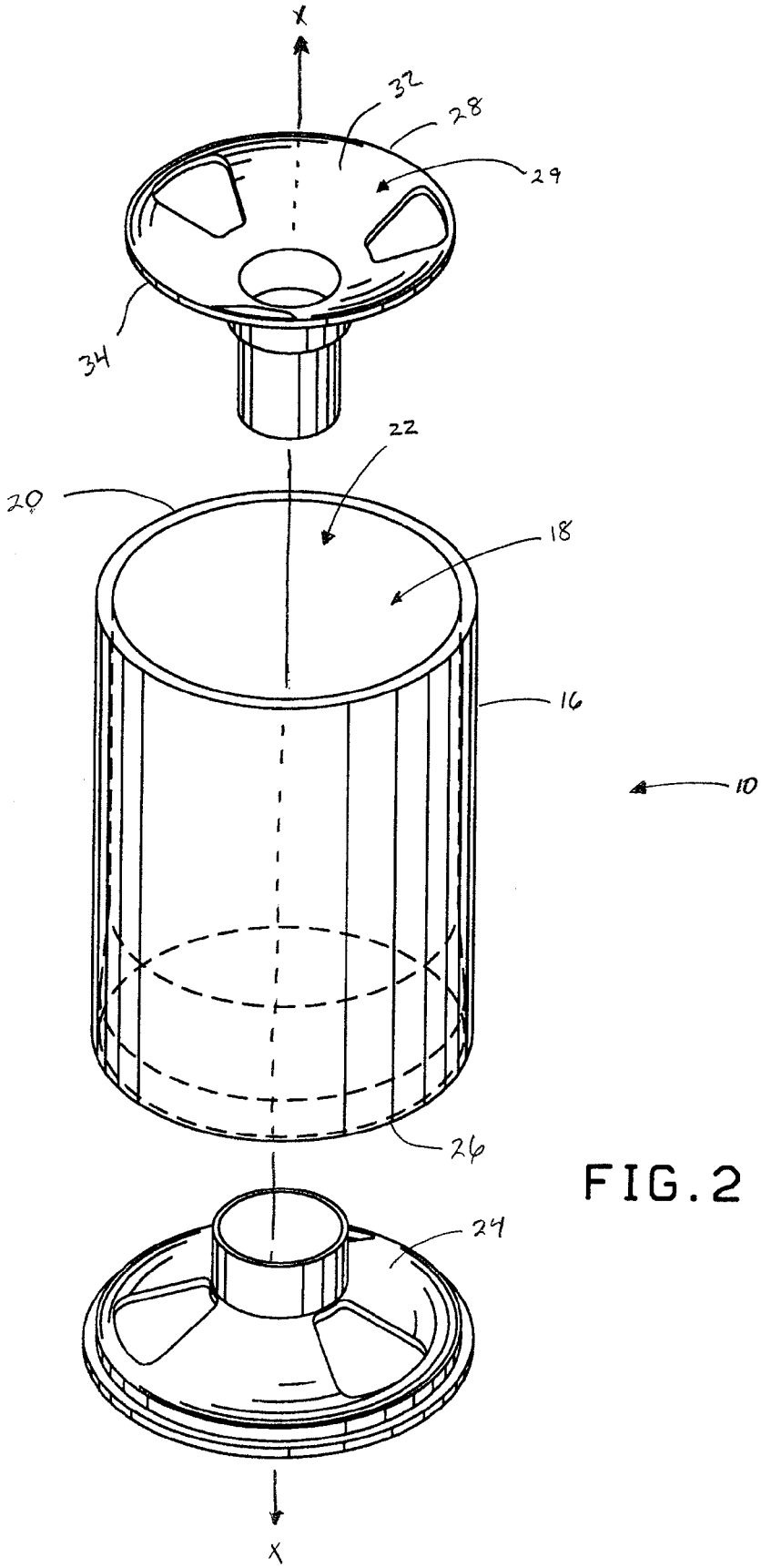
FIG. 2 is an exploded view of the golf cup of FIG. 1.

Turning to FIGS. 2 through 5, a first embodiment of the golf cup 10 is illustrated. In this form, the cup 10 includes a cylindrical wall 16 that defines an interior space or cavity 18 generally sized to receive a common golf ball. By one approach, the cylindrical wall has an inner diameter D (FIG. 4) of about 4 inches; however, depending on the application, other sizes are also possible. A first or upper edge 20 of the cylindrical wall 16 defines a golf ball receiving opening 22 that, in use, provides an entrance into the cup interior 18 that is typically recessed below ground level on a green as best shown in FIG. 1. The golf cup 10 further includes a base wall 24 fixed to a second or lower end 26 of the cylindrical wall 16 to define a bottom portion of the golf cup 10 as best shown in FIG. 4 (FIG. 2 is shown exploded for clarity). Positioned within the interior 18, the cup 10 also includes an insert 28 having an expanded upper surface portion 29 that substantially spans the interior 18. The insert 28 is positioned such that the upper surface portion 29 is spaced along a central longitudinal axis X of the cup 10 a predetermined distance A1 from the base wall 24 and a predetermined distance A2 from the cylindrical wall upper edge 20. As a result, the upper surface portion 29 of the insert 28 divides the cup interior 18 into a first or upper chamber 30 (between the receiving opening 22 and the insert upper surface 29) and a second or lower chamber 31 (between the base wall 24 and the insert upper surface 29).

In such form, the non-metallic cup 10 is arranged and configured to produce an audible indication of an object, such as a golf ball, being dropped into the cup 10 that preferably has a characteristic (such as frequency, volume, and/or pitch) similar to that of a golf ball being dropped into a metallic cup buried in the ground. The cup 10 achieves such sound characteristics even though it is preferably constructed from plastic materials.

Figure 5:
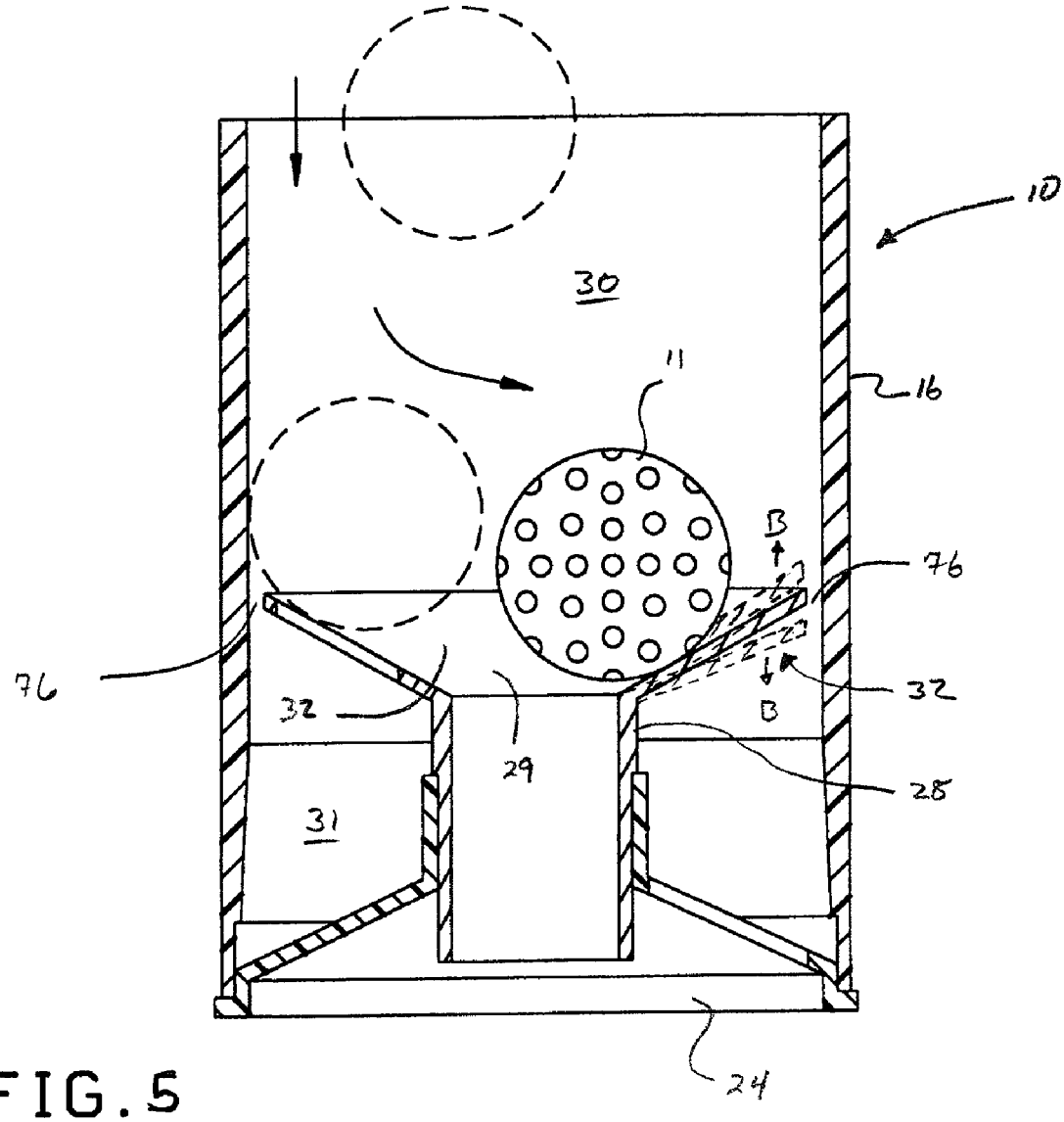
FIG. 5 is a cross-sectional view of the golf cup of FIG. 4 showing an exemplary golf ball being dropped into the cup.

To form such audible indication, the upper surface portion 29 of the insert 28 includes a portion 32 that is freely suspended over the lower chamber 31 in a manner effective to produce the audible indication when impacted by the golf ball 11. In a preferred form, the freely suspended portion 32 substantially spans the interior 18 of the golf cup 10 and has an outer edge 34 that is closely spaced to the cylindrical wall 16. In this manner, the freely suspended portion 32 is effective to produce the audible indication because it does not contact the cylindrical wall 16 and because it is arranged and configured to flex, vibrate, or resiliently bend upon being impacted by the golf ball as generally shown in FIG. 5.

While not wishing to be limited by theory, it is believed that the cup 10 is effective to produce the audible indication generally due to air resonance within the chambers 30 and 31.

That is, it is believed that the configuration of the cup 10 generally enables it to function similar to a Helmholtz resonator. For example, as illustrated in FIG. 5, when the golf ball 11 or other object strikes the freely suspended portion 32, it deflects, flexes, and/or vibrates and increases the air pressure contained in the lower chamber 31. When the higher pressure air in the lower chamber 31 attempts to exit out the opening 22 by traversing the distance A2 through the upper chamber 30, the characteristic sound of the metallic cup is formed via air resonance similar to a pipe organ or one blowing across the open mouth of a narrow bottle. By one approach, it is believed that a particular frequency ($f_H$) of the audible indication formed by the cup 10 is generally dependant on the inner cross-sectional area A of the cup 10 (i.e., $\pi(D/2)^2$), the volume V of the second or lower chamber 31 (i.e., generally $(A1)\pi(D/2)^2$), and a length L (i.e., generally A2) of the first or upper chamber 30 as generally provided by formula A were v is the speed of sound in air:

$$f_H = \frac{\upsilon}{2\pi}\sqrt{\frac{A}{VL}} \tag{A}$$

As a result, the characteristics of the audible indication generated by an object being dropped into the cup 10 will depend on the particular configuration of the cup 10. For example, as further described below, the size of the freely suspended portion 32, the relative sizes of the upper chamber 30 and the lower chamber 31, the diameter D of the cylindrical wall 16, the relative distances A1 and A2 of the chambers (and therefore relative volumes thereof), and/or the material selection of the insert 28 may all affect the particular characteristics of the audible indication. However, while formula A above generally describes one exemplary relationship between the cup configuration and sound frequency, the various cup parameters still have to be optimized to take into account the muffling of the sound due to the golf cup preferably being buried in a golf course green. As a result, the cups described herein optimize the cup configuration and various parameters to generate a distinctive audible indication that resembles a golf ball being dropped into a metallic cup that is buried in the ground.

Figure 6:
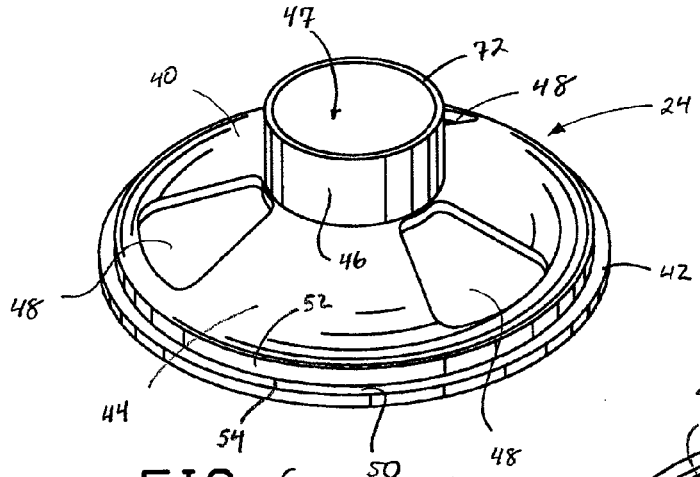
FIG. 6 is a perspective view of a bottom wall portion of the golf cup of FIG. 2.
Figure 7:
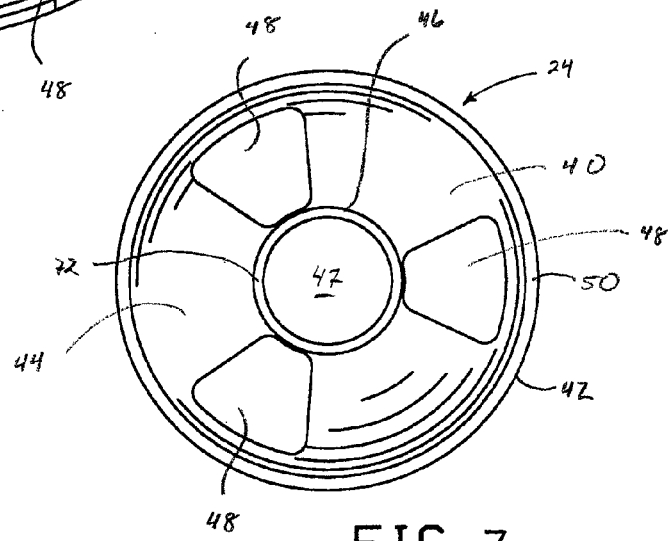
FIG. 7 is a top plan view of the bottom wall portion of FIG. 6.
Figure 8:
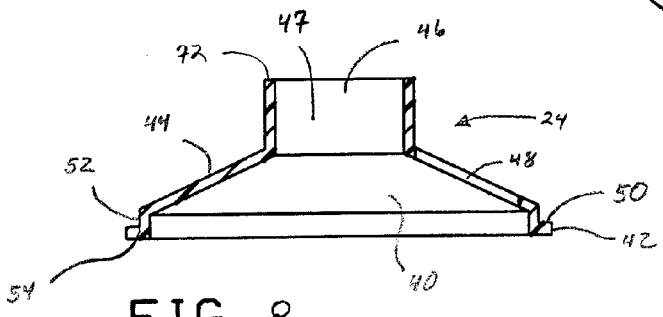
FIG. 8 is a cross-sectional view of the bottom wall portion of FIG. 6.

Turning to FIGS. 6 to 8, one form of the bottom wall 24 is illustrated. In this form, the bottom wall 24 is a disk-shaped member 40 having an outer annular lip flange 42 surrounding a surface portion 44 that inclines upwardly from adjacent the lip flange 42 to an upstanding annular projection 46, which is centrally positioned in the bottom wall 24. In one form, the annular projection 46 defines a bore 47 that is sized to receive and support a ferrule from a typical golf flag pole. In other forms, the bore 47 is also sized to securely receive and support the insert 28.

As shown, the surface portion 44 of the bottom wall 24 also preferably includes at least one, and preferably, a plurality of apertures 48 to permit rain, water, debris (dirt, sand, rocks, leaves, and the like), and other fluids to pass through the bottom wall 24 rather than accumulate in the interior 18 of the cup 10. Without the apertures 48 positioned on the bottom wall, water and/or debris may collect in the cup during use, which may affect the tonal qualities of the audible indication. While the apertures 48 are shown as being generally trapezoidal in configuration, other shapes, sizes, configurations, and positioning on the bottom wall 24 are also possible so long as the apertures 48 are effective to allow fluids and other debris to pass through the bottom wall 24 rather than accumulate in the cup 10.

In another aspect, the annular lip flange 42 defines a shoulder portion 50 to provide a surface configured to securely join the bottom wall 24 to the lower edge 26 of the cylindrical wall 16 as best illustrated in the cross-sectional view of FIG. 4. It is preferred that the bottom wall 24 be tightly secured to the cylindrical wall 16 in order to provide the best audible indication of a ball dropping into the cup 10. To this end, the bottom wall 24 may also include an upstanding wall 52 that extends upwardly from an inner edge 54 of the lip flange 42 to the surface portion 44. The upstanding wall portion 52 is preferably arranged and configured to be tightly secured to an inner surface 55 of the cylindrical wall 16. If desired, the inner surface 55 of the cylindrical wall 16 may also have an annular notch 56 at the bottom end 26 thereof to facilitate the receipt of the bottom wall 24 in a tight manner (see, e.g., FIG. 4).

To achieve a secure fit between the bottom wall 24 and the cylindrical wall 16, by one approach, the bottom wall 24 is fixed to the lower edge 26 of the cylindrical wall 16 through a press-fit, a friction-fit, a sonic weld, a heat weld, adhesive, glue, threading, screws, rivets, nails, or other suitable fastening mechanisms. As mentioned previously, the secure fit between the cylindrical wall 16 and the bottom wall 24 is preferred in order to provide the desired audible indication having the characteristics similar to the metallic cups. If the bottom wall 24 is only loosely secured to the cylindrical wall, the audible indication may not approximate that of a metallic cup and/or include rattles, vibrations, or other undesired audible characteristics that also render the sound less similar to that obtained from the metallic cups.

Turning to FIGS. 9 to 11, one form of the insert 28 is illustrated. In this form, the insert 28 is a generally cylindrical member that includes the upper surface portion 29 extending outwardly from a lower annular projection 60. The upper surface portion 29 preferably has a generally conic shape and inclines radially outward from an upper end 64 of the lower annular projection 60. As discussed above, the upper surface portion 29 includes the freely suspended portion 32, which is configured to initiate the air resonance upon being impacted by an object in order to produce the audible indication. The lower annular projection 60 also may define a central bore 62 that extends through the upper surface portion 29. The bore 62 is preferably sized to frictionally receive and support a typical ferrule from a golf flag pole as best shown in FIG. 1.

In order to form the desired audible indication, it is preferred that the insert 28 be formed from a non-metallic material, and most preferably from an elastic, resilient and/or plastic material. It has been discovered that some non-metallic materials generate the desired audible indication while other non-metallic materials produce an audible indication with a higher or lower frequency. For instance, it is most preferred that the insert be formed from a nylon, such as DuPont Zytel™. With all other factors constant, other materials, such polyester (GE Valox™) or Delrin, result in an audible indication that does not approximate that obtained from a metallic cup as they generally produce an audible indication with a higher frequency.

To form the chambers 30 and 31, the insert 28 is securely received in the bore 47 formed by the upstanding annular projection 46 of the cup bottom wall 24. To this end, the insert lower annular projection 60 generally has an outer diameter D1 (FIG. 11) sized to be press-fit or frictionally received in the bore 47 in a secure and tight manner. It is preferred that the insert 28 also be securely fastened to the bottom wall 24 in order to provide the desired audible indication characteristic of that obtained from metallic cups. In this regard, rather than a press-fit or friction-fit, the insert may also be secured to the bottom wall through a sonic weld, a heat weld, adhesive, glue, threading, screws, rivets, nails, or other suitable fastening mechanisms. If the insert is only loosely secured to the bottom wall, the audible indication may not approximate that from a metallic cup and may also include other undesired aspects such as rattles and/or vibrations. Alternatively, the insert 28 and bottom wall 24 may also be molded as a single piece.

By one approach, in order to position the surface portion 29 of the insert 28 at the predetermined distance A1 from the bottom wall 24, the lower annular projection 60 may also have a notch 68 formed therein so that a ledge 70 is defined at a predetermined position on the lower annular projection 60. As a result, when the lower annular projection 60 is received in the bottom wall bore 47, the insert ledge 70 rests on an upper edge 72 (FIG. 8) of the upstanding annular projection 46 so that the upper surface portion 29 is positioned at the desired predetermined distance A1. While the notch 68 is one such mechanism to achieve the distance A1, other mechanisms may also be used to achieve this distance. As further discussed below, varying the distance A1, which varies the relative sizes of the chambers 30 and 31, is but one of the factors that generally varies the frequency of the audible indication.

The upper surface portion 29 also preferably defines at least one, and most preferably, a plurality of through holes 74 that are spaced circumferentially about the insert central bore 62. The through holes 74 permit fluids and other debris (such as, for example, fluids, sand, leaves, rocks, and the like) to drain or pass through the interior 18 of the cup rather than accumulating therein. In one form, the through holes 74 are positioned adjacent the outer edge 34 of the upper surface portion 29 and are defined by an inner edge 75 of the upper surface portion 29 so that a narrow strip 76 connects adjacent freely suspended portions 32 on either side of each through hole 74.

In another aspect, the size and configuration of the through holes 74 also generally affect the characteristics of the audible indication by varying the size, position, and/or resiliency of the freely suspended portion 32. For example, the total cross-sectional area and placement of the through hole(s) 74 on the upper surface portion 29 generally affects the ability of the freely suspended portion 32 to vibrate or move when impacted by a golf ball or other object. Varying the ability of the freely suspended portion 32 to vibrate or move may increase or decrease the air pressure in the lower chamber 31, which may affect the sound characteristics of the audible indication.

For example, in combination with other factors as further described below, to produce the desired audible indication, each through hole 74 has a cross-sectional area of about 0.5 to about 0.6 square inches, and the upper surface portion 29 preferably has three through holes 74, which are equi-spaced circumferentially about the bore 62, for a total cross-sectional area of about 1.5 to about 1.8 square inches. Such configuration of the through holes 74 in combination with the preferred insert material, the preferred configuration of the upper chamber 30 and lower chamber 31 results in the audible indication similar to that obtained from a metallic cup. Of course, other cross-sectional areas, shapes, positioning, and numbers of the through hole(s) 74 may also be used depending on the desired audible indication, variations of the chamber sizes, and/or variations in the cup materials.

With other factors being constant, it is believed that a larger total cross sectional area of the through hole(s) 74 generally provides a higher frequency, and a smaller total cross sectional area of the though hole(s) 74 generally provides a lower frequency. For example, an increase in total cross-sectional area of the through hole(s) 74 generally results in the freely suspended portion 32 being more resilient, able to vibrate more easily, and/or configured to move a greater amount when impacted by an object. On the other hand, with a decreased total cross-sectional area of the through hole(s) 74, the upper surface portion 29 will be more rigid, vibrate less easily, and/or move a lesser amount when impacted by an object. In either case, the characteristics of the audible indication, such as volume, pitch, frequency, and the like, are varied such that the audible indication no longer approximates the characteristic sounds of a metallic golf cup.

Referring back to FIGS. 4 and 5, the golf cup 10 forms an assembly of the cylindrical wall 16, the bottom wall 24, and the insert 28 that is configured to produce the distinctive audible indication approximating that of a metallic cup even when formed from non-metallic components. As discussed previously, when joined together in this fashion, the insert 28 forms the upper chamber 30 and the lower chamber 31 as best shown in FIG. 4. The relative sizes of these two chambers also generally affects the characteristics of the audible indication. By one approach, the distance A1 of the lower chamber 31 is about 1.25 to about 2.5 inches, and most preferably about 2 to about 2.25 inches. The distance A2 of the upper chamber 30 is preferably about 3 to about 4 inches, and most preferably about 3.25 to about 3.5 inches. The cylindrical wall 16 preferably has a diameter of about 4 inches, which is typical of a standard golf cup. With such chamber sizes, the first or upper chamber 30 has a volume ratio to the second or lower chamber 31 from about 1:0.3 to about 1:0.7. In other words, it is preferred that the first or upper chamber 30 have a larger volume than the second or lower chamber 31. This larger volume upper chamber 30 (derived from the distance A2 being generally greater than the distance A1) generally provides for a lower sounding audible indication.

Optionally, as best shown in FIG. 4, the bottom wall 24 and insert 28 also include inclined portions such that the distances A1 and A2 may vary radially from adjacent the annular projections 46 and 60 to the cylindrical wall 16. That is, for example, distance A1 may vary from about 1.25 inches adjacent the annular projections 46 and 60 to about 2.25 inches adjacent the cylindrical wall 16. Likewise, the distance A2 may vary from about 4 inches along the central, longitudinal axis X to about 3.25 inches at the cylindrical wall 16.

In use, once the freely suspended portion 32 of the insert 28 is impacted by an object, such as the golf ball 11, it is believed that the freely suspended portion 32 resiliently flexes or vibrates to form a pressure increase in the lower chamber 31, such as illustrated by the movement arrows B in FIG. 5. It will be appreciated, however, that the movement of the upper surface portion 29 in FIG. 5 is only exemplary, and more or less motion of the insert 28 may be observed when impacted by an object. Depending on the insert configuration, the upper surface portion 29 may flex less than a millimeter or several millimeters.

Such flexing or vibration of the freely suspended portion 32 results from it not being connected, attached, or touching the cylindrical wall 16. The insert upper surface portion 29, and preferably the freely suspended portion 32 thereof, substantially spans the interior 18 of the cylindrical wall as best shown in FIG. 3, but does not touch the cylindrical wall 16. That is, the outer edge 34 of the freely suspended portion 29 is closely spaced 76 to the inner surface 55 of the cylindrical wall 16. By one approach, the outer edge 34 of the freely suspended portion 32 is spaced from the cylindrical wall 16 up to about 1/16 of an inch, and most preferably about 0.0030 of an inch. In this form, the upper surface portion 29 is preferably supported only at the junction 64 with the lower annular projection 60, and therefore, is free to flex or bend. If the upper surface portion 29 and/or the freely suspended portion 32 touches or is connected to the cylindrical wall 16, it will not flex, vibrate, and/or move sufficiently to initiate the air resonance to form the desired audible indication.

Figure 12:
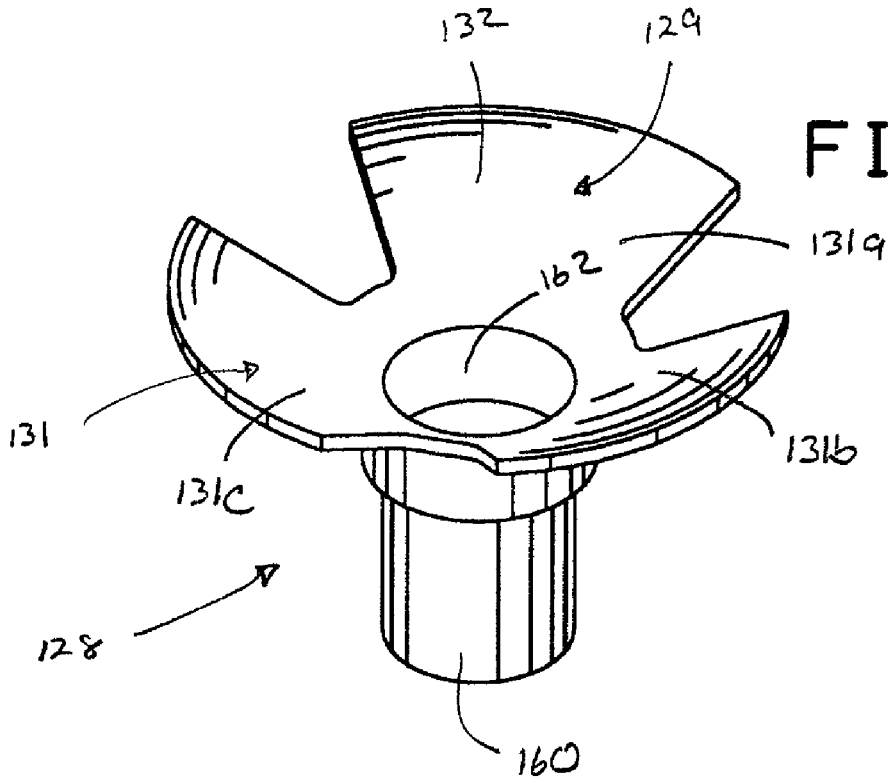
FIG. 12 is a perspective view of an alternative insert portion of the golf cup of FIG. 2.
Figure 13:
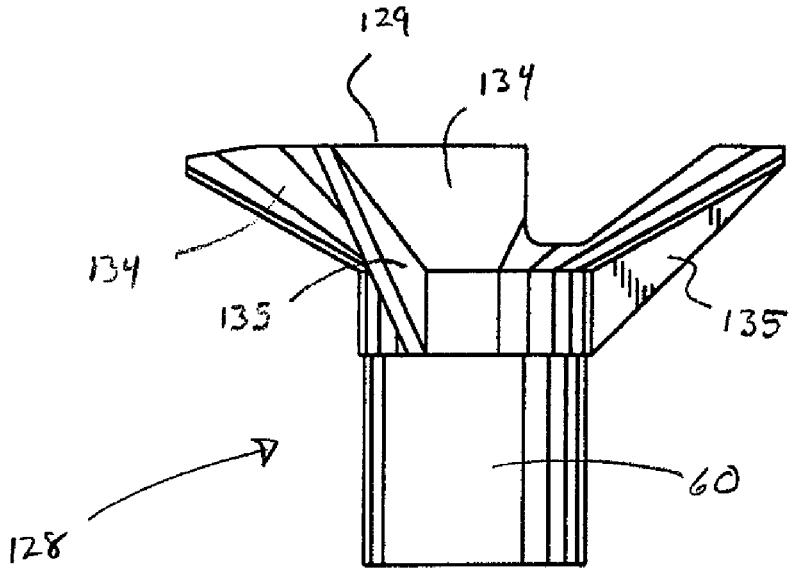
FIG. 13 is a side elevational view of the alternative insert portion of FIG. 12.

Turning to FIGS. 12 and 13, an alternative insert 128 is illustrated that may also be joined to the bottom wall 24 of the cup 10. The insert 128 is similar to the previously described insert 28; therefore, only the differences will be described further. In general, the insert 128 includes a lower cylindrical portion 160 that is sized to be frictionally received by the bottom wall annular projection 46 as described above with the insert 28. In this alternative form, the insert 128 includes an upper surface 129 also having a freely suspended portion 132, but in the form of a plurality of freely suspended lobes 131, such as lobes 131*a*, 131*b*, and 131*c*. Preferably, the lobes 131 are equally spaced about a central bore 162 formed by the lower cylindrical portion 160 and, when joined to the cup bottom wall 24, divide the golf cup 10 into the two chambers 30 and 31. When positioned in the cup 10, the freely suspended lobes 131 of the insert 128 are also spaced from the cylindrical wall 16, and function in a manner similar to the freely suspended portion 32 of the previously described insert 28. The lobes 131 flex, vibrate, and/or move in response to the impact of an object (i.e., the golf ball 11) to initiate the audible indication via air resonance.

As best shown in FIG. 13, the lobes 131 may also include optional supports 135 on an underside 137 of each lobe 131. As shown, the supports 135 can be generally triangular-shaped ribs, extensions, gussets, and the like that project from a side of the lower cylindrical projection 160 and extend along the underside 134 of each lobe 131. The supports 135 help provide resistance to the flexing by generally making each lobe more rigid. While it is preferred that all lobes 131 include the stiffening supports 135, it is also possible that less than all lobes 131 may include the supports in order to produce varied sounds. In addition, while the insert 128 is shown with three lobes, more or less lobes 131 may also be formed on the insert 128 depending on the desired audible indication.

It will be understood that various changes in the details, materials, and arrangements of parts and components which have been herein described and illustrated in order to explain the nature of the golf cup may be made by those skilled in the art within the principle and scope as expressed in the appended claims.

What is claimed is:

1. A golf cup comprising:

a cylindrical wall defining an interior and having a receiving opening on one end thereof, the cylindrical wall having a central longitudinal axis;

a base wall fixed to the other end of the cylindrical wall and inclined relative to the cylindrical wall;

an insert formed from a non-metallic material positioned in the interior and having a lower projection mounted to the base wall and a freely suspended portion integrally joined with an end of the lower projection and extending outwardly from the lower projection end;

the freely suspended portion spaced from the base wall a distance along the longitudinal axis to form a first chamber between the freely suspended insert portion and the ball receiving opening and a second chamber between the base wall and the freely suspended insert portion;

the second chamber forming a generally cone-shaped, unobstructed sound producing cavity;

the freely suspended insert portion, the first chamber, and the second chamber are arranged and configured to effect an audible indication upon an object directly impacting the freely suspended insert portion as it resiliently flexes into the second chamber; and wherein the audible indication is achieved in the absence of metallic components but is similar to that achieved from a golf ball being dropped into a metallic golf cup buried in ground.

2. The cup of claim 1, wherein insert is positioned in the interior of the cylindrical wall such that the insert does not contact the cylindrical wall.

3. The golf cup of claim 2, wherein the freely suspended insert portion substantially spans the interior of the cylindrical wall.

4. The golf cup of claim 3, wherein an outer edge of the freely suspended insert portion is closely spaced to an inner surface of the cylindrical wall.

5. The golf cup of claim 4, wherein the outer edge is spaced less than about 1/16 of an inch from the cylindrical wall.

6. The golf cup of claim 1, wherein the first chamber has a larger volume than the second chamber.

7. The golf cup of claim 6, wherein a ratio of the volume of the first chamber to a volume of the second chamber is about 1:0.3 to about 1:0.7.

8. The golf cup of claim 6, wherein the freely suspended portion is spaced about 1.25 to about 2.5 inches from the base wall.

9. The golf cup of claim 6, wherein the freely suspended portion is spaced about 3 to about 4 inches from the cylindrical wall receiving opening.

10. The golf cup of claim 1, wherein the freely suspended portion defines at least one through hole providing access to the second chamber.

11. The golf cup of claim 10, wherein the at least one through hole has a cross sectional area of about 0.5 to about 0.6 square inches.

12. The golf cup of claim 10, wherein the freely suspended portion defines a plurality of through holes.

13. The golf cup of claim 12, wherein the plurality of through holes has total cross section area of about 1.5 to about 1.8 square inches.

14. The golf cup of claim 1, wherein the base wall defines a central passage and the insert includes a depending annular projection sized to be press-fit in the base wall central passage.

15. The golf cup of claim 14, wherein the insert further defines a central bore substantially concentric with the base wall central passage, the central bore sized to receive and support a golf flag pole.

16. The golf cup of claim 1, wherein the insert is formed from a nylon.

17. The golf cup of claim 1, wherein the insert portion includes a plurality of separate lobes freely suspended over the second chamber and each lobe configured to initiate the audible indication upon the object impacting one of the lobes.

18. The golf cup of claim 17, wherein each lobe includes a support rib to provide resistance to flexing.

19. The golf cup of claim 17, wherein the insert portion includes at least three lobes.

* * * * *